US007597573B2

(12) United States Patent
Defibaugh et al.

(10) Patent No.: US 7,597,573 B2
(45) Date of Patent: Oct. 6, 2009

(54) LOW PROFILE HIGH CURRENT POWER CONNECTOR WITH COOLING SLOTS

(75) Inventors: George R. Defibaugh, Harrisburg, PA (US); Nancy L. Reeser, Lemoyne, PA (US); George I. Peters, Harrisburg, PA (US); Don Wood, Hummelstown, PA (US); Michael Allen Blanchfield, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/678,954

(22) Filed: Feb. 26, 2007

(65) Prior Publication Data

US 2008/0207029 A1 Aug. 28, 2008

(51) Int. Cl.
*H01R 4/60* (2006.01)
*H01R 4/64* (2006.01)

(52) U.S. Cl. ..... 439/206; 439/290

(58) Field of Classification Search ..... 439/206, 439/608, 79, 290, 552
See application file for complete search history.

(56) References Cited

U.S. PATENT DOCUMENTS

| | | | | |
|---|---|---|---|---|
| 4,959,028 | A | 9/1990 | Garay et al. | |
| 5,582,519 | A | 12/1996 | Buchter | |
| 5,630,720 | A | 5/1997 | Kocher | |
| 5,667,392 | A | 9/1997 | Kocher et al. | |
| 6,402,566 | B1 * | 6/2002 | Middlehurst et al. | 439/699.1 |
| 6,514,103 | B2 * | 2/2003 | Pape et al. | 439/608 |
| 6,575,776 | B1 | 6/2003 | Conner et al. | |
| 6,811,411 | B1 | 11/2004 | Hirata et al. | |
| 6,814,590 | B2 * | 11/2004 | Minich et al. | 439/79 |
| 6,835,103 | B2 | 12/2004 | Middlehurst et al. | |
| 6,890,221 | B2 | 5/2005 | Wagner | |
| 6,923,661 | B1 | 8/2005 | Bogiel et al. | |
| 7,001,189 | B1 | 2/2006 | McGowan et al. | |
| 7,059,919 | B2 | 6/2006 | Clark et al. | |
| 7,065,871 | B2 | 6/2006 | Minich et al. | |
| 7,097,495 | B2 | 8/2006 | Sweetland | |
| 7,182,642 | B2 * | 2/2007 | Ngo et al. | 439/608 |
| 7,258,562 | B2 * | 8/2007 | Daily et al. | 439/290 |
| 7,458,839 | B2 * | 12/2008 | Ngo et al. | 439/291 |
| 2006/0194472 | A1 | 8/2006 | Minich et al. | |
| 2006/0228927 | A1 | 10/2006 | Daily et al. | |
| 2006/0228948 | A1 | 10/2006 | Swain et al. | |
| 2007/0293084 | A1 | 12/2007 | Ngo | |

OTHER PUBLICATIONS

ConnectorSupplier.com, New Product Release titled "FCI's HCI Connector System Addresses Increasing Current Density Demands", dated Jan. 2007, p. 1 of 1.

* cited by examiner

*Primary Examiner*—Hae Moon Hyeon

(57) ABSTRACT

A low profile, high power electrical connector assembly is disclosed. The connector assembly includes a plug and a receptacle connector designed to be mounted on separate printed circuit boards. The plug and receptacle connectors are designed to be mated and thus allow the separate circuit boards to be electrically connected in tandem in either the same plane or perpendicular to one another. The connector assembly includes a plug contact and a receptacle contact provided with cooling slots and an at least partially open rear face configured to permit the dissipation of heat.

16 Claims, 11 Drawing Sheets

415
425
20
420
445
423
437
421
422
436
95
90
410
438
439
430
21
440

LOW PROFILE HIGH CURRENT POWER CONNECTOR WITH COOLING SLOTS

FIELD OF THE INVENTION

The present invention is directed to a low profile high current power connector and, particularly, to a low profile high current power connector for mounting on a printed circuit board.

BACKGROUND OF THE INVENTION

Various types of electrical connectors containing contacts are designed for mounting on a printed circuit board. The contacts have terminating ends for connection to appropriate circuit traces on the board, such as solder tails for solder connection to the circuit traces on the board and/or in holes in the board. Some electrical connectors have been used to make electrical connections between the circuits on different printed circuit boards. These electrical connectors include power and signal transfer connectors between the circuit boards.

Generally, such connectors include a dielectric or insulating housing that mounts one or more conductive contacts to the circuit board. The housing is configured to mate with a complimentary mating connector mounted on another circuit board. The mating of the housings also provides for the mating of the contacts contained therein. In such a manner, the configuration forms a connector assembly that includes a pair of mating connectors, such as a plug and receptacle connector, which are sometimes called male and female connectors, respectively.

Board mounted connectors may be used to provide a transfer connection of electrical power, electrical signal or both between the boards. In this case of board-to-board power connector assemblies, the connector couples power circuitry to or from power circuits on the printed circuit board. With ever-increasing density of components used in electronic packaging, electrical power connectors often are needed to carry high current between a circuit board and a complimentary mating connector or other connecting device, or between one circuit board and another circuit board. The current provided to the connecting device is distributed to various circuit traces on the circuit board.

A typical board mounted power connector includes a housing containing at least one electrical contact. A board mounted power connector assembly includes a plug connector, referred to as a male connector, and a receptacle connector, referred to as a female connector. The plug and receptacle connectors are designed to mate by fitting the housings of the plug and receptacle together while forming an electrical connection between the electrical contacts contained therewithin. The fit of the plug and receptacle must provide for a secure, reliable connection.

It is often desirable to mate circuit boards in tandem and along or within the same plane. To do so, the electrical contacts must be perpendicularly inserted into the circuit board and then redirected 90 degrees, becoming parallel with the circuit board. The housing must be similarly designed to allow for attachment upon the circuit board with an attachment face for receiving a mating connector in a direction parallel to the circuit board surface. It is desirable to reduce the profile of the connector assembly above the circuit board to improve air movement and thus increase cooling to the circuit board. In such a manner, the overall height of the mated circuit boards can be reduced and the ability to stack circuit boards above one another at a reduced overall height can be improved.

However, power connectors up to this time have been unable to provide a secure connection with a low profile connector that is capable of carrying high current density between the boards. As such, there is an unmet need to provide a power connector with a reduced profile while providing for a secure connection and the ability to carry high current.

The present invention is designed to solve the above problems with a board mounted power connectors and to provide improved features in such connectors.

SUMMARY OF THE INVENTION

This invention provides for a low profile, high power electrical connector assembly. The connector assembly includes a plug and a receptacle connector designed to be mounted on separate printed circuit boards. The plug and receptacle connectors are designed to be mated and thus allow the separate circuit boards to be electrically connected. The connector assembly allows electrical power to be transferred between the circuit boards. The connector assembly may also allow for the transfer of electrical signals between the connected boards.

In an exemplary embodiment of the invention, a low profile, high power electrical connector assembly is provided for mounting on a printed circuit board. The connector assembly includes at least one electrical power connection. The connector assembly includes a plug connector and a receptacle connector. The plug connector and receptacle connector are mounted on separate circuit boards that allow the boards to be electrically connected in tandem.

The plug connector includes a housing and at least one electrical contact to provide a power connection. The plug housing is formed of a dielectric material such as a high temperature plastic. The plug housing includes a contact tail section and a shroud section. The contact tail section covers a portion of the power contact that provides electrical connectivity to a circuit board. The portion of the power contact that provides electrical connection to the circuit board may be compliant pins that are inserted into holes in the circuit board or tails that are soldered to the circuit board surface. The portion of the power contact may also be a wire connection for providing an electrical connection between the plug power contact and other electrical components.

The shroud section of the plug housing covers a portion of the contact that provides electrical connectivity with a corresponding mating contact of the receptacle connector. The shroud section of the plug housing is designed to receive and cover a corresponding shroud section of the receptacle housing.

The plug housing may have support ribs for improving the strength of the plug housing shroud. The support ribs of the plug housing mate with recesses in the receptacle housing to provide additional strength to the plug housing shroud. The shape of the support ribs may vary.

The plug housing may also be formed with ribs on the interior of the top and bottom surfaces of the plug housing shroud section to improve plug shroud wall strength and provide housing alignment during mating. The ribs are designed to engage with slots on the receptacle housing shroud section. The ribs may be present on the top, bottom or both surfaces of the plug housing shroud section.

The plug housing may be formed with a guide opening for receiving a tab of the receptacle housing to assist in aligning the mating surfaces of the plug and receptacle housings. The guide opening may be a cavity formed into at least one side of the plug housing for receiving a corresponding tab of a receptacle housing.

The plug housing may be formed with cooling slots in the contact tail section to improve cooling to the contacts. The plug housing may have cooling slots formed in the shroud section to further improve cooling to the contact. Furthermore, the plug housing is formed with a rear face that allows for air to circulate around the contacts. The rear face of the plug housing is at least partially open.

The receptacle connector includes a housing and at least one electrical contact. The receptacle housing is formed of a dielectric material. The receptacle housing has a contact tail section and a shroud section. The contact tail section covers a portion of the contact that provides electrical connection to the circuit board. The electrical connection to the circuit board may be by compliant pins or solder tails of the receptacle contact. The shroud section covers a portion of the contact that provides electrical connectivity with a corresponding mating contact of the plug connector. The shroud section of the receptacle housing is designed to be inserted into the shroud section of the plug housing.

The receptacle housing has support columns for guiding the plug contact into engagement with the receptacle contact. The support columns may have recesses or other contact surface for engaging the support ribs of the plug housing so as to improve the strength of the plug housing shroud.

The receptacle housing may be formed with slots on the top and bottom surfaces of the receptacle housing shroud section to engage corresponding ribs of the plug housing to improve strength of the plug connector. The slots may be present on the top, bottom or both surfaces of the receptacle housing shroud section so as to engage with corresponding ribs of the plug housing.

The receptacle housing may be formed with a tab for engaging a guide opening of the plug housing to assist in aligning the mating surfaces of the plug and receptacle housings. The tab may be formed on at least one side of the receptacle housing for engaging a corresponding guide opening member of the plug housing.

The receptacle housing may be formed with cooling slots in the contact tail section to improve cooling to the contacts. The receptacle housing may have cooling slots formed in the shroud section to further improve cooling to the contacts. The cooling slots of the receptacle housing shroud section are located to be aligned with cooling slots of the plug housing shroud section when the connector assembly is mated. Furthermore, the receptacle housing is formed with a rear face that allows for air to circulate around the contacts. The rear face of the receptacle housing is at least partially open.

The connector assembly may be formed with at least one signal connection in addition to at least one electrical power connection. If the connector assembly is formed with a signal contact connection, the plug connector and the receptacle connector are formed with a housing signal section to support at least one signal contact to form the at least one signal connection. The sections of the housing of the plug connector and the receptacle connector that cover the at least one signal contact may be provided with cooling slots to further increase air circulation and improve cooling to the signal and power contacts. The signal contact section of the plug housing may be provided with ribs and the signal contact section of the receptacle housing may be provided with slots to engage the ribs to improve the strength and reliability of the connector assembly.

The housing of the plug and receptacle connectors may be formed of a dielectric plastic material that is high strength. The housing may be formed of a high temperature liquid crystalline polymer or any other known industry acceptable non-conductive dielectric housing material. The housings may be formed of a thermally conductive dielectric plastic material in order to draw heat away from contacts within the housing.

The plug power contact is formed with compliant pins or solder tails to provide an electrical connection to a circuit board. The plug power contact is also formed with a front projection for connection to corresponding receptacle contact. In a similar manner, the receptacle power contact is formed with compliant pins or solder tails to provide an electrical connection to a circuit board and with a front receiving projection for engaging a corresponding plug power contact. The power contacts are formed of a highly conductive pliant material such as a copper alloy. An exemplary metal alloy is copper nickel silicon alloy.

The plug signal contact may be provided in the form of a signal pin column or array for mounting in the plug housing signal section. The receptacle signal contact may be provided as a signal receptacle column or array for mounting in the receptacle housing signal section. The plug signal contact and the receptacle signal contact may be a single contact.

The signal contacts are formed of a conductive pliant material such as a metal or copper alloy. An exemplary metal alloy is phosphor bronze.

The plug and receptacle connectors may be attached to circuit boards so as to allow the circuit boards to be attached in the same plane or perpendicular to one another. If the circuit boards are attached along or within the same plane, the plug and receptacle connectors provide a 90 degree or right angle electrical connections to the board. If the circuit boards are to be attached perpendicular to one another, either the plug or the receptacle connector provides a 90 degree electrical connection to the circuit board, and the other connection provides a vertical connection to the circuit board. The connector providing the vertical connection will have compliant pins or solder tails mounting on the board with a mating face parallel to the board so as to provide a mating connection perpendicular to the board.

The plug and receptacle connectors may be attached to their appropriate circuit boards by any known conventional mounting technologies. These attachment methods include through hole solder techniques. Wave soldering and the use of board hold down features on housings may be used. The connectors may be manually mounted.

The cooling slots allow for increased power to be transferred between the plug and receptacle connectors at a lower operational temperature because of improved cooling to the electrical contacts, both power and signal, if present. Additionally, the connectors have an open rear face design that improves air circulation and increases cooling. Furthermore, the connectors have a low profile design that further promotes increased cooling by allowing for improved air circulation above the circuit board. The total height of the power connector assembly may be less than 8 mm above the circuit board. The total height of a power/signal connector assembly may be less than 9 mm above the circuit board.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

FIG. 4(*b*) illustrates an exemplary view of a portion of the plug mating face.

DETAILED DESCRIPTION OF THE INVENTION

Figure 1:
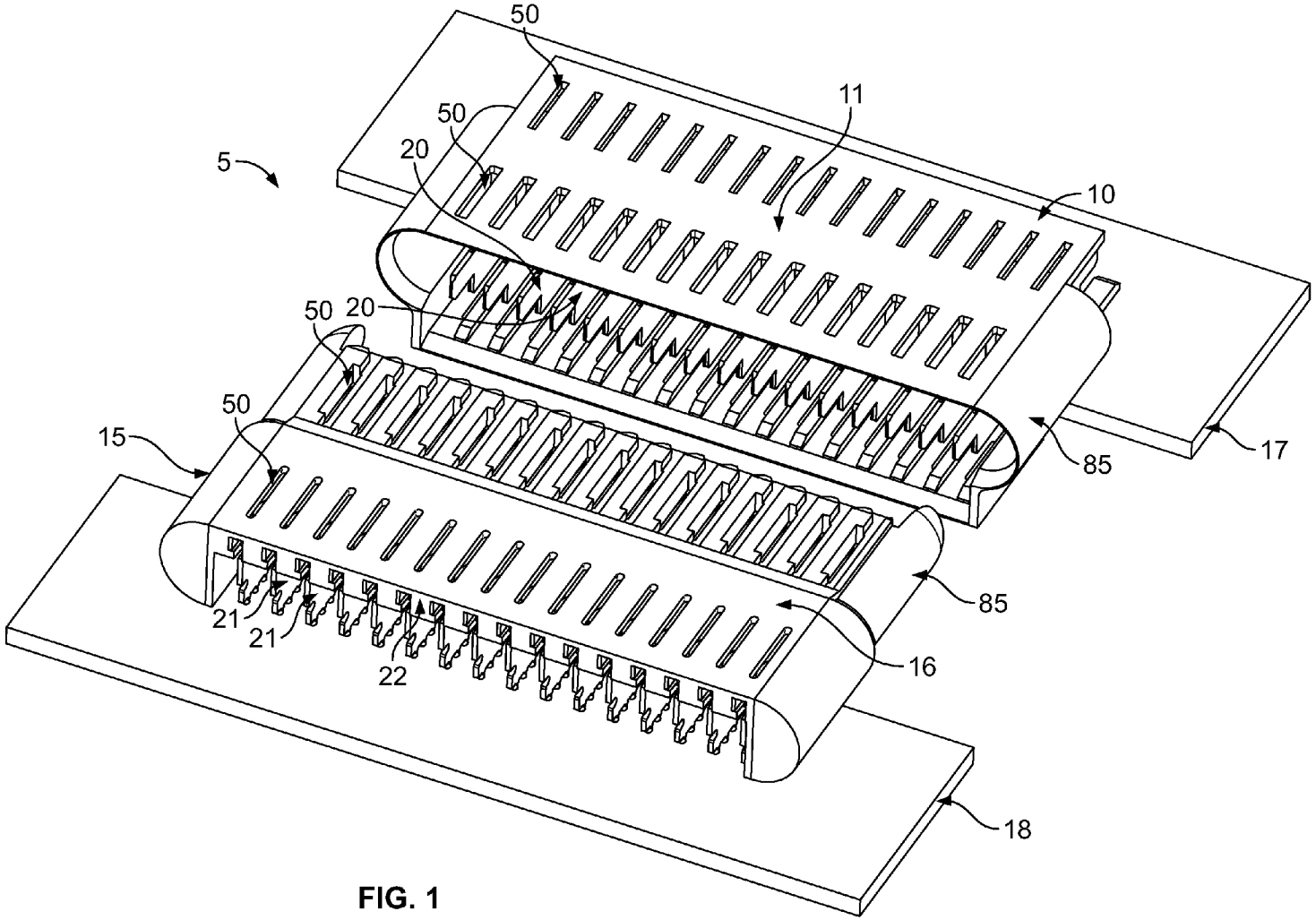
FIG. 1 illustrates an exemplary unmated power connector assembly.

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Referring to FIGS. 1, 2, 3, 4(*a*) and 4(*b*), an embodiment of an unmated power connector assembly 5 is shown. The connector assembly includes a plug power connector 10 and a receptacle power connector 15. The plug connector 10 is formed of a plug connector housing 11 and plug power contacts 20. The receptacle connector 15 is formed of a receptacle connector housing 16 and receptacle power contacts 21. The plug connector housing 11 and the receptacle connector housing 16 are formed of a dielectric plastic material having a high strength. The plug connector housing 11 is formed with at least one cooling slot 50. The receptacle connector housing is also formed with at least one cooling slot 50. The housing may be formed of a high temperature liquid crystalline polymer or other suitable contact housing material.

The plug connector 10 and the receptacle connector 15 are designed to mate and connect plug power contacts 20 to receptacle power contacts 21. The plug connector 10 and receptacle connector 15 when mated can provide a power connection between a first circuit board 17 and a second circuit board 18, respectively. First circuit board 17 and second circuit board 18 are printed circuit boards or similar electrical devices that are in electrical communication with plug power contacts 20 and receptacle power contacts 21. In this embodiment, the first circuit board 17 and the second circuit board 18 are connected in the same plane. However, either the plug connector 10 or the receptacle connector 15 may be configured with a housing and contact that permits perpendicular attachment of the first circuit board 17 and the second circuit board 18. This embodiment allows a perpendicular connection being within the ordinary skill in the art. The maximum height of the plug connector 10 and the receptacle connector 15 when attached to a circuit board for the power connector assembly is preferably less than 8 mm above the circuit board surface.

As can be seen in FIG. 1, the receptacle connector 15 has an at least a partially open rear face 22. The at least partially open rear face 22 of the receptacle connector 15 allows for the receptacle power contacts 21 to be exposed to allow heat dissipation and airflow access. In such a manner, cooling air may enter or be forced via a fan or other air-moving device into the receptacle connector 15 through the open rear face 22 and exit through cooling slots 50 or through the similar open rear face (not shown) of the plug connector 10. Plug connector 10 also has an at least partially open rear face (not shown) of similar construction to the at least partially open rear face 22 of the receptacle connector 15 for exposing the plug contacts 20 of the plug connector 10 to circulating cooling air. It should be understood that cooling air entering the at least partially open rear face 22 of the receptacle connector 15 and entering the at least partially open rear face (not shown) of the plug connector 10 would circulate throughout the connector assembly 5 when mated. The cooling slots 50 allow for heat generated within the plug connector 10 and the receptacle connector 15 to escape without any forced air directed upon the plug connector 10 or receptacle connector 15, although forced air may be used to further increase cooling. The cooling slots 50 and structure of both the plug connector 10 and receptacle connector 15 allow air to pass through the plug connector 10 and receptacle connector 15 and around plug contacts 20 and receptacle contacts 21 to draw heat away from both the plug contacts 20 and receptacle contacts 21 and their associated housings.

In another embodiment, the circuit board 17 and circuit board 18 are connected perpendicular to one another. In this embodiment, the plug connector 10 is provided, as shown in the previous embodiment, making a right angle connection to the circuit board 17, and the receptacle connector 15 is modified to make a vertical connection to circuit board 18. In this embodiment, cooling air may enter the open rear face (not shown) of the plug connector 10 and would exit through cooling slots 50, since the modification to the receptacle connector 15 would mostly restrict or close an open rear face of the plug connector 10. This may be important since airflow is often provided to the rear of the plug connector 10. Alternatively, the plug connector 10 could be modified to provide a perpendicular connection and the receptacle connector 15 would remain as in the first embodiment.

Figure 2:
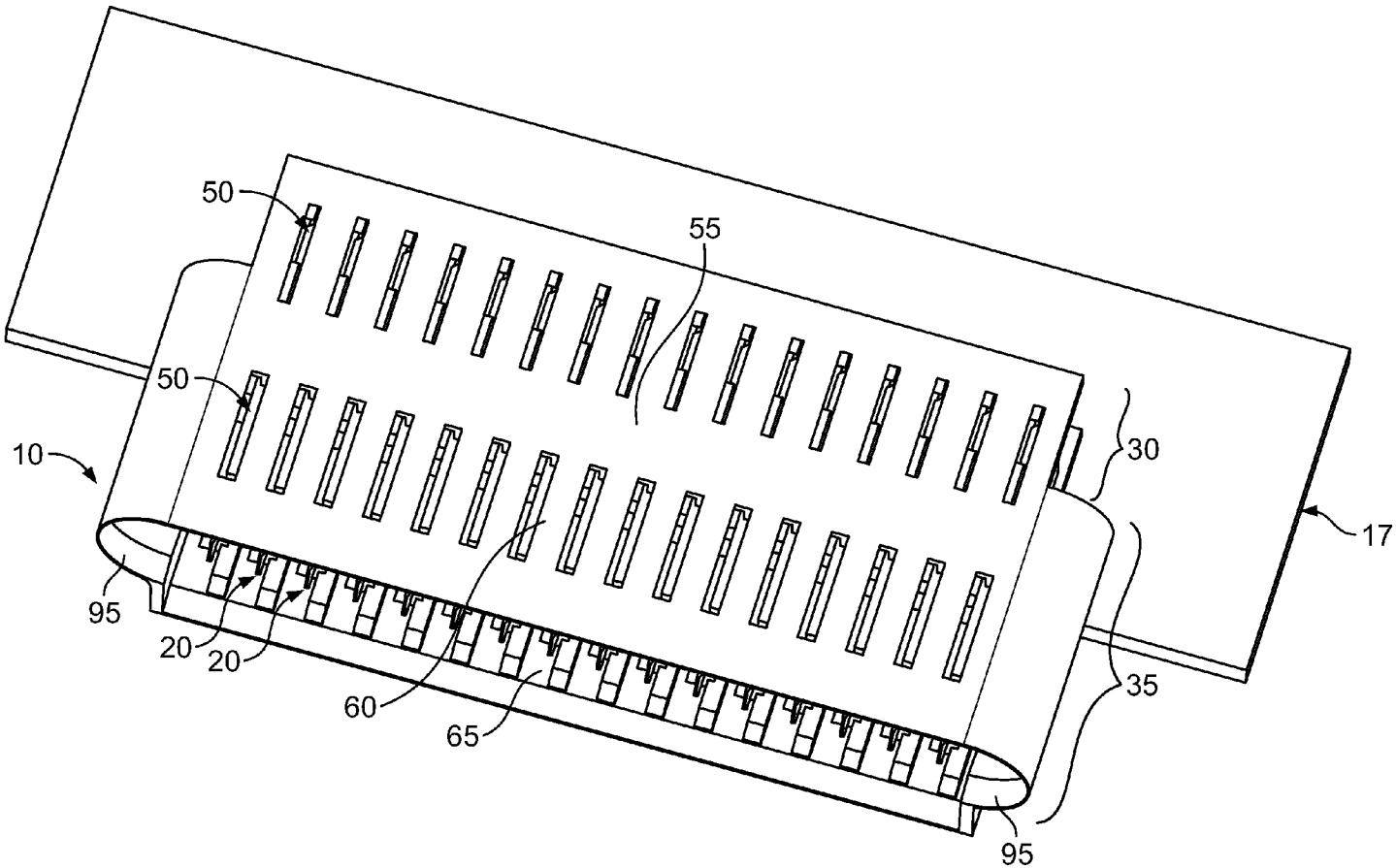
FIG. 2 illustrates an exemplary plug power connector.

As shown in FIG. 2, the plug power connector 10 is shown having a top surface 55. The plug connector 10 has a plug contact tail section 30 and a plug shroud section 35. The plug contact tail section 30 covers the compliant pins (not shown) of a plug power contacts 20. The plug shroud section 35 covers the front protrusion of a plug power contacts 20.

Cooling slots 50 are provided on the top surface 55 of the plug power connector 10 on both the plug tail section 30 and the plug shroud section 35. Cooling slots 50 may also be provided on the plug shroud section bottom surface 65. As discussed above with respect to FIG. 1, the cooling slots 50 allow the passage of air for cooling of the plug power contacts 20.

Figure 3:
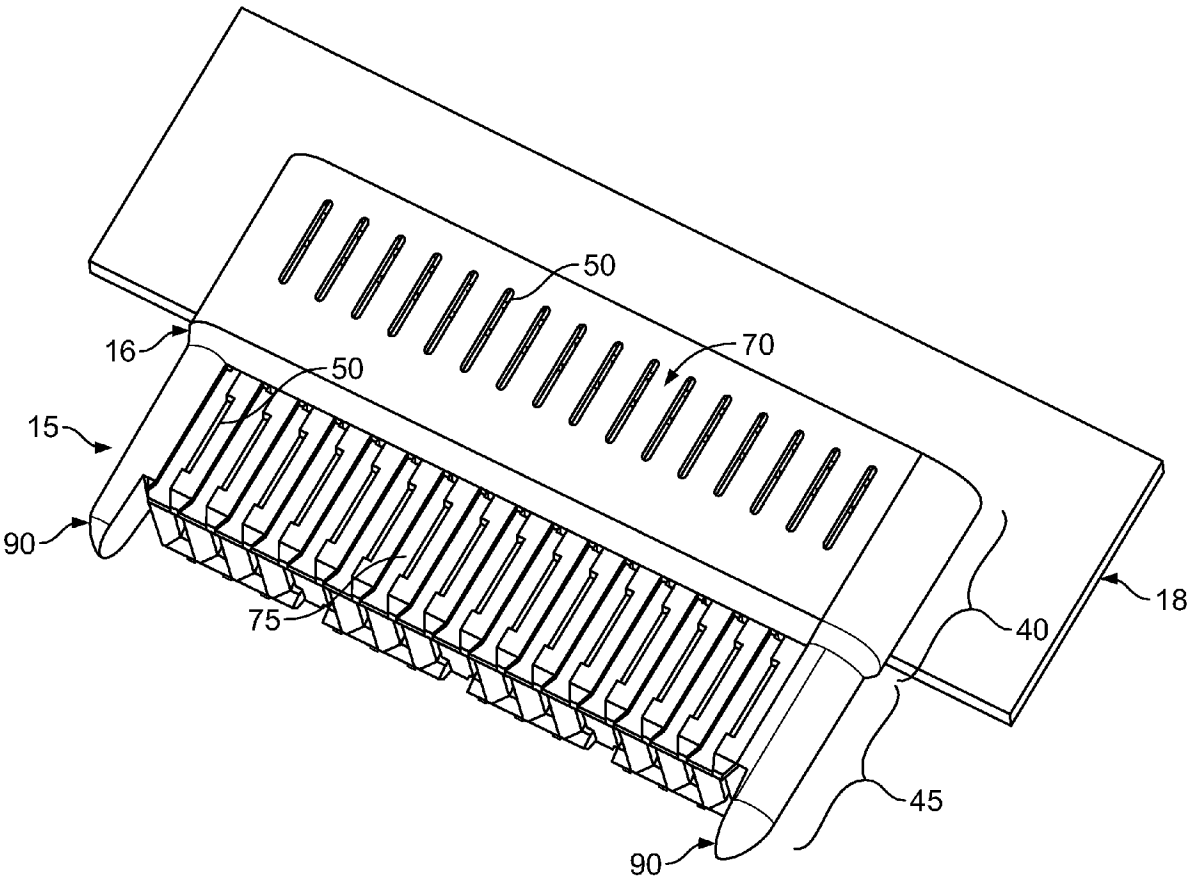
FIG. 3 illustrates an exemplary receptacle power connector.

As shown in FIG. 3, the receptacle connector 15 has a receptacle contact tail section 40 and a receptacle shroud section 45. The receptacle connector 15 has a top surface 70 that covers both the contact tail section 40 and the shroud section 45. The receptacle contact tail section 40 covers the compliant pins of a receptacle power contact (not shown) contained within the receptacle housing 16. The receptacle shroud section 45 covers a front receiving protrusion of a receptacle power contact (not shown).

Cooling slots 50 are shown on the top surface 70 of the receptacle connector housing 16 on both the receptacle tail section 40 and the receptacle shroud section 45. Cooling slots 50 may also be provided on the receptacle shroud section bottom surface (not shown). As discussed above with respect to FIG. 1, the cooling slots 50 allow the passage of air for cooling of the receptacle power contacts 21.

The cooling slots 50 of the tail sections of the plug connector 10 and the receptacle connector 15 are shown not extending into their housing shroud sections, but they may be lengthened or modified to extend closer to the tail sections. In addition, the cooling slots 50 of the shroud sections of the plug connector 10 and the receptacle connector 15 may be modified to extend closer to their housing tail sections. It should be apparent that the size and the location of the cooling slots 50 may vary depending upon the current load and ventilation provided to the connector assembly 5. The cooling slots 50 of the plug connector shroud section 35 and the cooling slots 50 of the receptacle connector shroud section 45 are preferably positioned so as to be aligned when the connector assembly 5 is mated. The cooling slots 50 of the plug shroud section 35 and the receptacle shroud section 45 may be present only on the top surfaces or may be present on both the top and bottom surfaces of the shroud sections. Also, the cooling slots 50 may be omitted from the plug connector shroud section 35 and the receptacle connector shroud section 45.

The unmated connector assembly 5 of FIG. 1. is shown with a passive guide system 85 that includes a tabs 90 on the receptacle connector 15 and guide openings 95 on the plug connector 10. The passive guide system 85 assists with the mating of the receptacle connector 15 and plug connector 10.

Figures 4A, 4B:
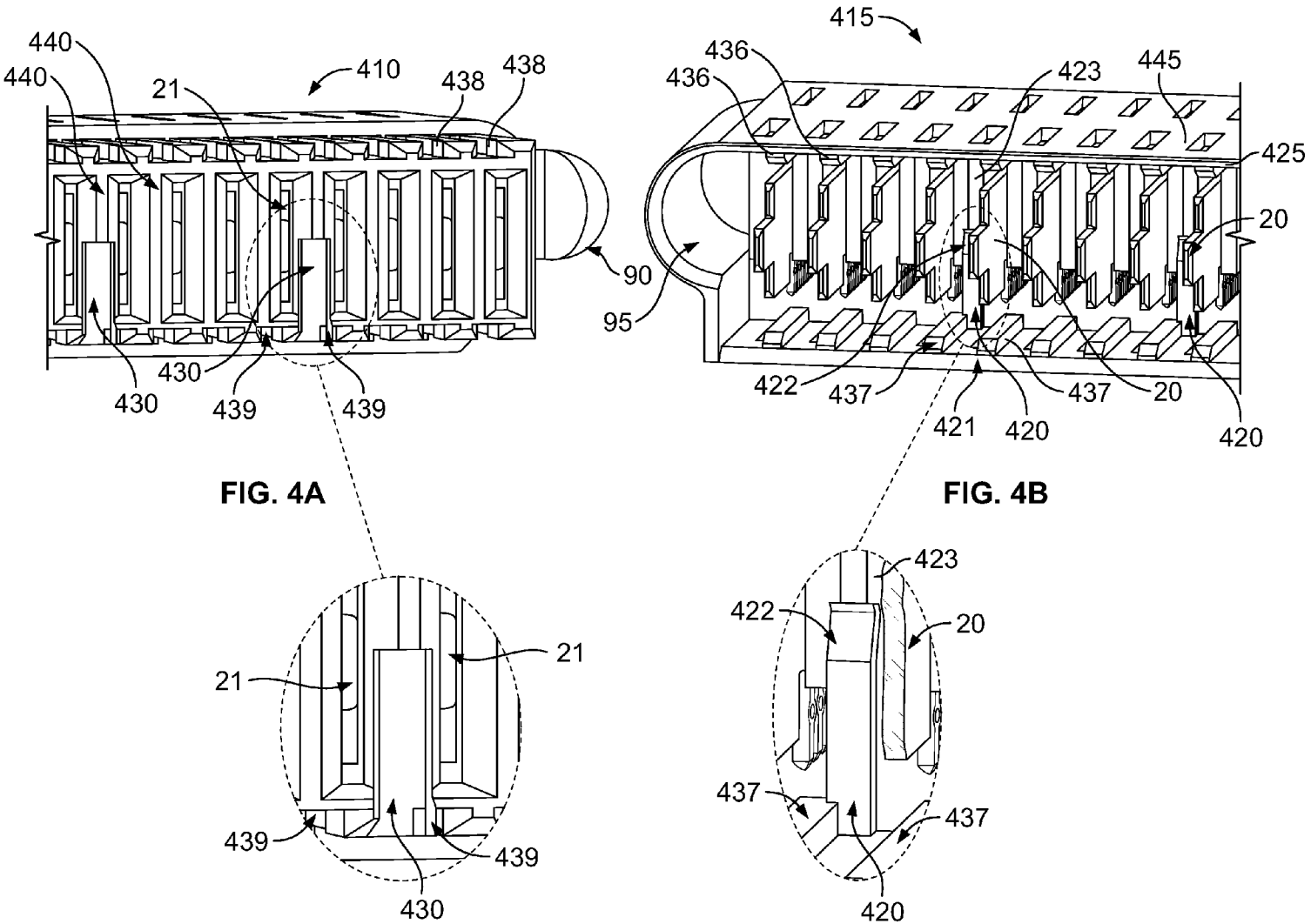
FIG. 4(*a*) illustrates an exemplary view of a portion of the receptacle mating face.

FIGS. 4A and 4B show a detailed view of the receptacle mating face 410 and plug mating face 415. The plug mating face 415 is exemplary of a section of the mating face of plug connector 10 and plug housing 11 as shown in FIG. 2. The receptacle mating face 410 is exemplary of a section of the mating face of receptacle connector 15 as that shown in FIG. 3. Plug mating face 415 is shown with plug power contacts 20, and receptacle mating face 410 is shown with corresponding receptacle power contacts 21.

The plug mating face 415 is shown having support ribs 420 and a slotted support structure 423. Support ribs 420 improve the stiffness and strength of the plug connector, especially when the plug connector contains 6 or more contacts, and are especially necessary when the plug connector contains up to 30 contacts. The slotted support structure 423 is provided in the tail section of the housing 11 for supporting and aligning power contacts 20. The slotted support structure 423 is attached to the top surface 425 of the tail section 30 of the housing 11. The support ribs 420 are shown in the detailed cutaway with an exemplary design with a front notch 422. The support ribs 420 extend from a plug bottom wall 421 to the slotted block structure 423 in the tail section 30 of the plug housing 11. The slotted block structure 423 supports and aligns contacts 20 in the plug housing 11.

The receptacle mating face 410 is designed with support columns 440 for guiding plug contacts 20 into corresponding receptacle contacts 21. Support columns 440 may be beveled as shown to assist in guiding of the corresponding plug contacts 20. Support columns 440 are designed with recesses 430 for receiving corresponding support ribs 420. FIGS. 4A and 4B also show tab 95 and guide opening 90 of the optional passive guide system 85.

The plug mating face 415 is shown with top ribs 436 on the plug top wall 425. The plug mating face 415 also has bottom ribs 437 on the plug bottom wall 421. The receptacle mating face 410 is shown with top rib receiving slots 438 and bottom rib receiving slots 439 for receiving the top ribs 436 and bottom ribs 437, respectively. Either or both of the top ribs 436 and bottom ribs 437 may be present with their corresponding receiving slots to improve stiffness and alignment to the connector assembly. The top ribs 436 and bottom ribs 437 are shown spaced between each plug contact but may be spaced in any manner that improves stiffness and alignment to the connector assembly.

Figure 5B:
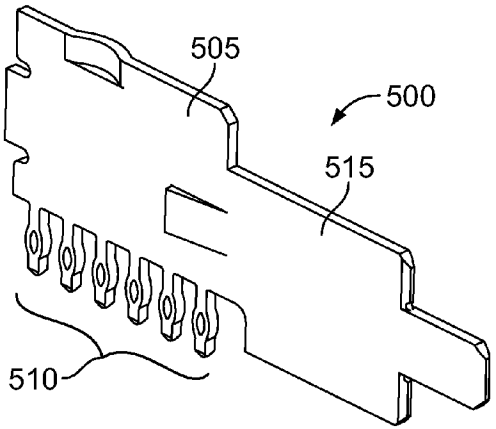
FIGS. 5(*a*) and 5(*b*) illustrate an exemplary plug power contact.
Figure 5A:
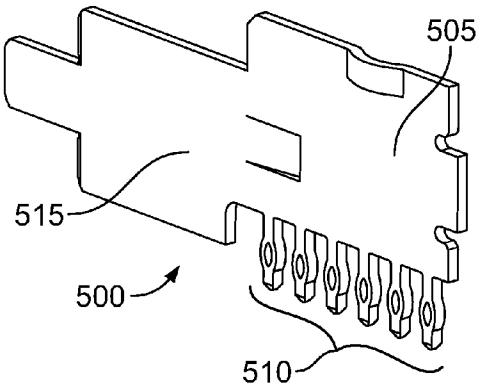

A detailed view of a plug power contact 500 is shown in FIGS. 5(*a*) and 5(*b*). The plug contact 500 is formed with a body 505, compliant pins 510, and a front protrusion 515 for providing an electrical mating surface to a suitable receptacle contact. The compliant pins 510 are for forming an electrical connection with a circuit board by known methods in the art. The plug contact may be formed of a highly conductive pliant material such as copper nickel silicon alloy.

Figure 6B:
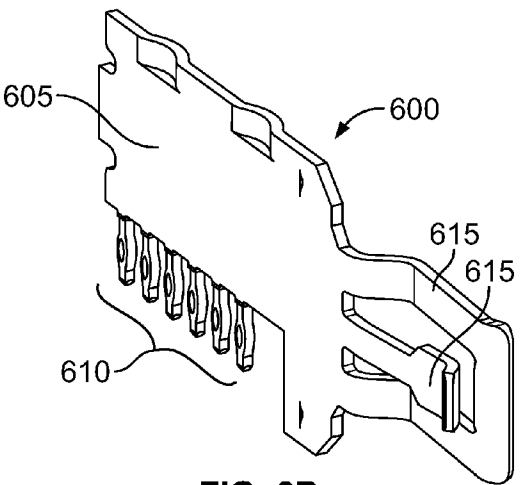
FIGS. 6(*a*) and 6(*b*) illustrate an exemplary receptacle power contact.
Figure 6A:
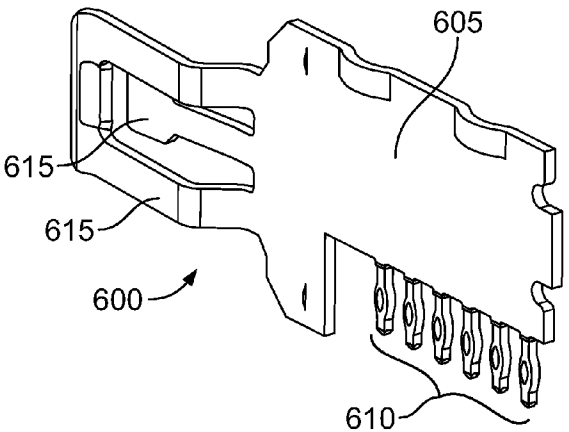

A detailed view of a receptacle power contact 600 is shown in FIGS. 6(*a*) and 6(*b*). The receptacle contact 600 is shown with a body 605, compliant pins 610, and a front receiving protrusion 615 for providing an electrical mating surface to a suitable corresponding plug contact. The receptacle contact may be formed of highly conductive pliant material such as copper nickel silicon alloy.

Figure 7:
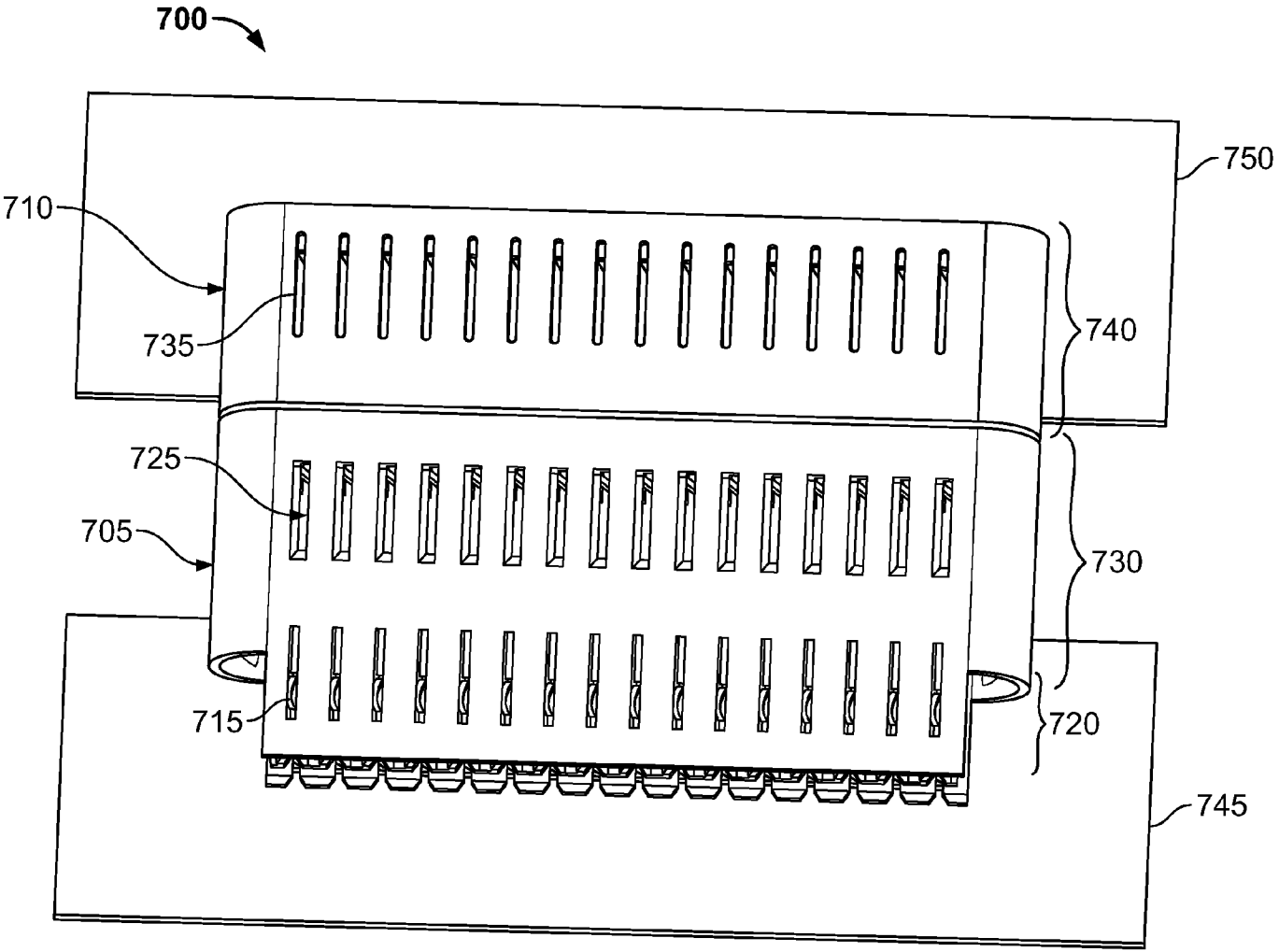
FIG. 7 illustrates an exemplary mated power connector assembly.

FIG. 7 illustrates a mated power connector assembly 700 according to another embodiment of the invention formed by a plug power connector 705 and a receptacle power connector 710. The plug connector is shown with cooling slots 715 in the plug tail section 720. FIG. 7 also shows cooling slots 725 formed into the plug shroud section 730. Not shown in FIG. 7 are the cooling slots formed into the receptacle shroud section contained within the plug shroud section 730 and aligned with the cooling slots 725 on the plug shroud section 730. The receptacle connector 710 has cooling slots 735 formed into the receptacle connector tail section 740. The mated power connector assembly 700 establishes an electrical power connection between a first circuit board 745 and a second circuit board 750.

Figure 8:
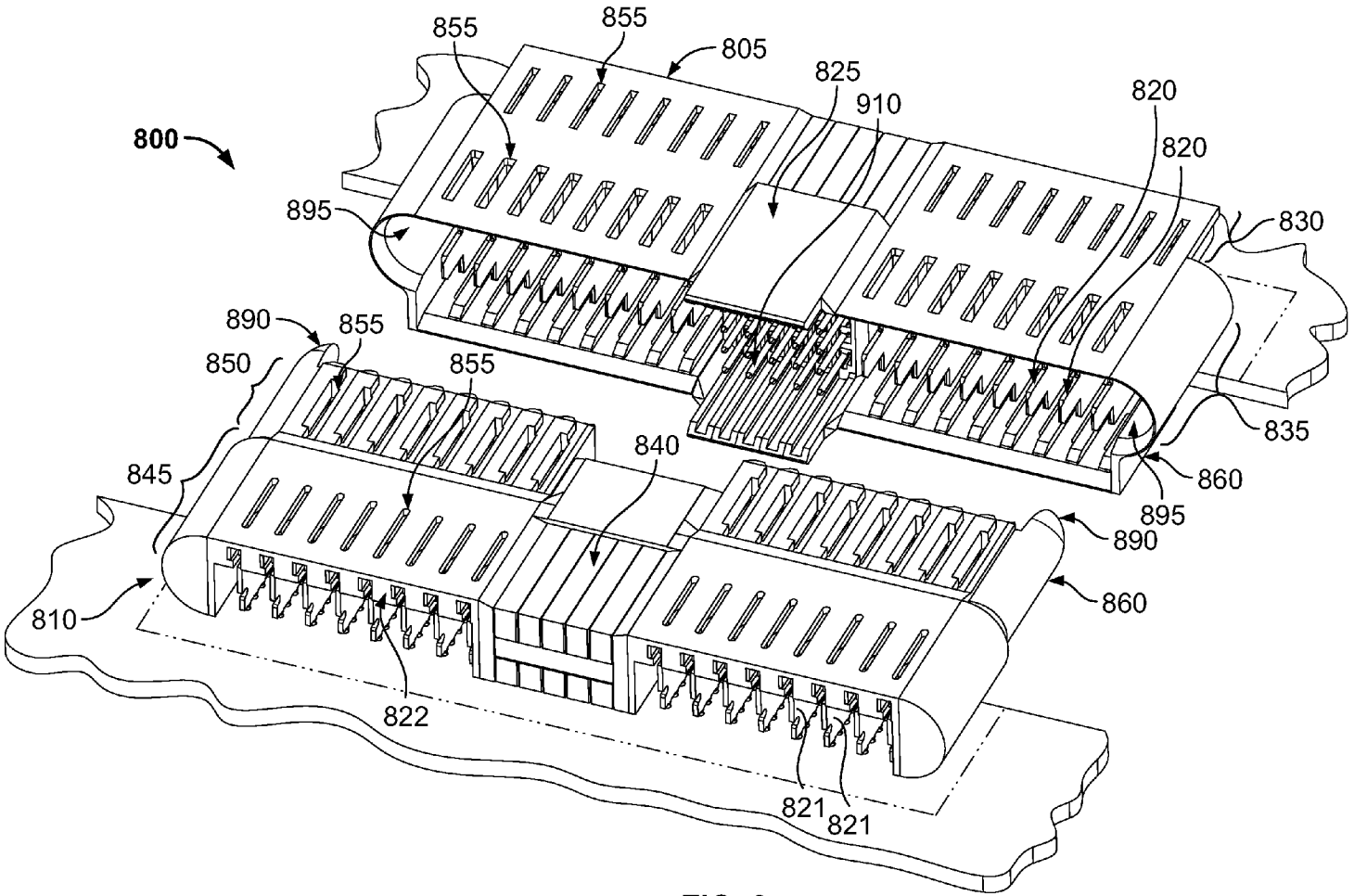
FIG. 8 illustrates an exemplary unmated power/signal connector assembly.

FIG. 8 shows an additional exemplary embodiment of an unmated power/signal connector assembly 800 that includes a plug connector 805 and receptacle connector 810. The plug connector has power contacts 820 and at least one plug signal contact 910 for providing power and signal connections to corresponding receptacle power contacts 821 and the at least one receptacle signal contact (not shown) in the receptacle connector 810, respectively. The plug connector 805 has a signal contact section 825, a plug contact tail sections 830, and a plug shroud section 835. The receptacle connector 810 has a signal contact section 840, a receptacle contact tail section 845, and a receptacle shroud section 850.

Cooling slots 855 are shown on the plug contact tail section 830, plug connector shroud section 835, receptacle connector contact tail section 845, receptacle connector shroud section 850. Cooling slots may also be formed into the plug and receptacle shroud bottom surfaces (not shown). It should be apparent that the size and the location of the cooling slots 855 may vary depending upon the current load and ventilation provided to the connector assembly 800. Cooling slots 855 may be omitted from the plug shroud section 835 and the receptacle shroud section 850. When present, the cooling slots 855 of the plug connector shroud section 835 and the cooling slots 855 of the receptacle connector shroud section 850 are positioned so as to be aligned when the connector assembly 800 is mated.

As can be further seen in FIG. 8, the receptacle connector 810 has an at least a partially open rear face 822. The at least partially open rear face 822 of the receptacle connector 810 allows for the receptacle power contacts 821 to be exposed to circulating cooling air. In such a manner, cooling air may enter or may be forced into the receptacle connector 810 through the open rear face 822 and exit through cooling slots 855 or through the similar open rear face (not shown) of the plug connector 805. Plug connector 805 also has an at least partially open rear face (not shown) of similar construction to the at least partially open rear face 822 of the receptacle connector 810 for exposing the plug contacts 820 of the plug connector 805 to circulating cooling air. It should be understood that cooling air entering the at least partially open rear face 822 of the receptacle connector 810 and entering the at least partially open rear face (not shown) of the plug connector 805 would circulate throughout the connector assembly 800 when mated.

The unmated connector assembly 800 is shown with a passive guide system 860. The passive guide system includes tabs 890 on the receptacle connector 810 and guide openings 895 on the plug connector 805. The passive guide system 860 assists with the alignment and mating of the plug connector 805 and the receptacle connector 810.

Figure 9:
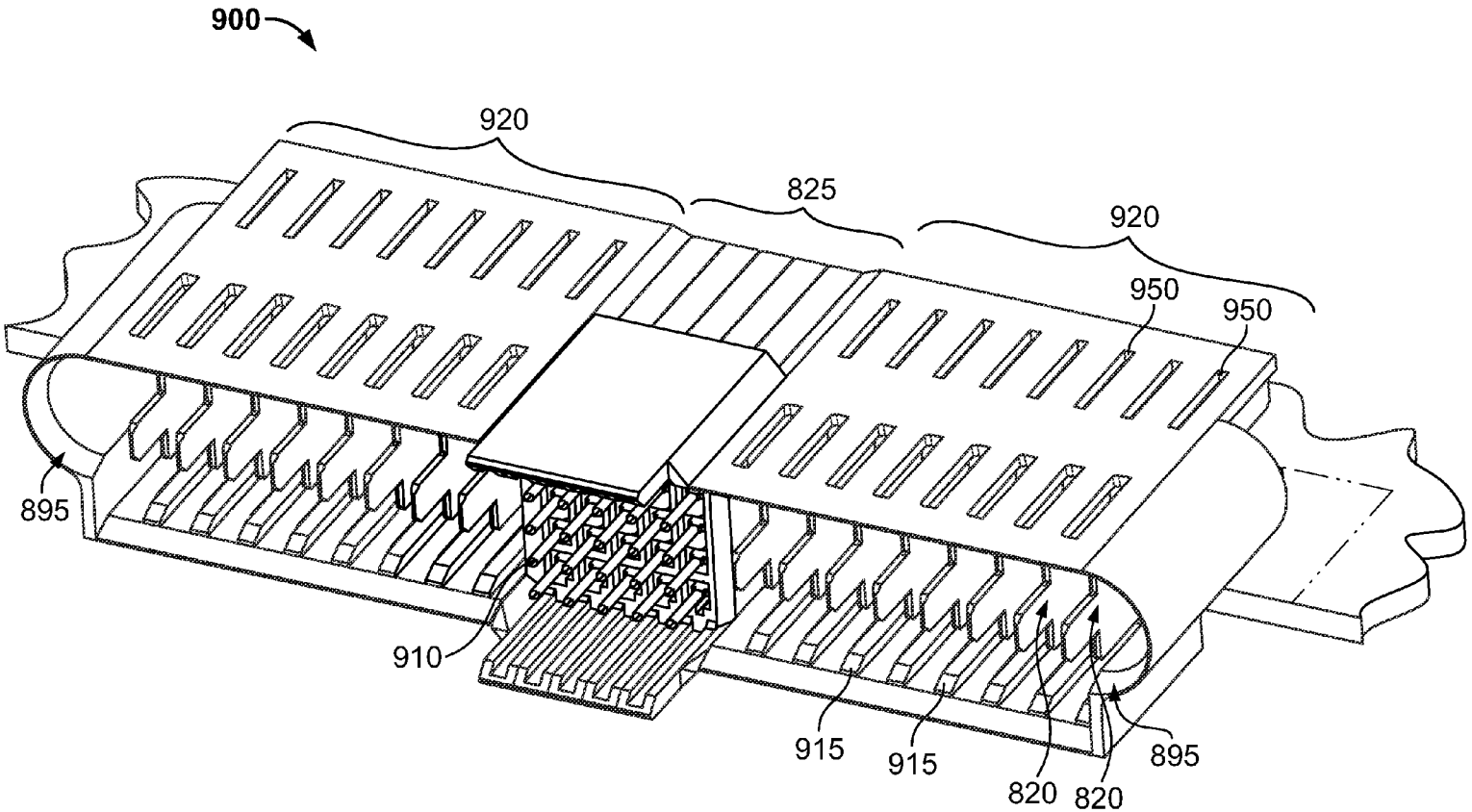
FIG. 9 illustrates an exemplary plug power/signal connector.

FIG. 9 illustrates a more detailed view of still another exemplary embodiment of a plug power/signal connector 900. As shown in FIG. 9, cooling slots 950 are formed on the power connection sections 920 of the plug connector 900. Cooling slots 950 are formed similarly as the cooling slots of the plug power connector embodiment previously discussed. FIG. 9 also shows the positioning of the plug power contacts 820 and plug signal contacts 910. The plug signal contacts are contained within the signal connection section 825 of the connector 900. Connector 900 includes ribs 915 to improve strength and stiffness of the connector 900. Plug connector 900 also is shown with a guide openings 895 for receiving a corresponding tab from a receptacle connector.

Plug power contacts 820 and receptacle power contacts (not shown) are the same or similar to the plug power contacts and receptacle power contacts as described in the power connector assembly embodiment described earlier.

Figure 10:
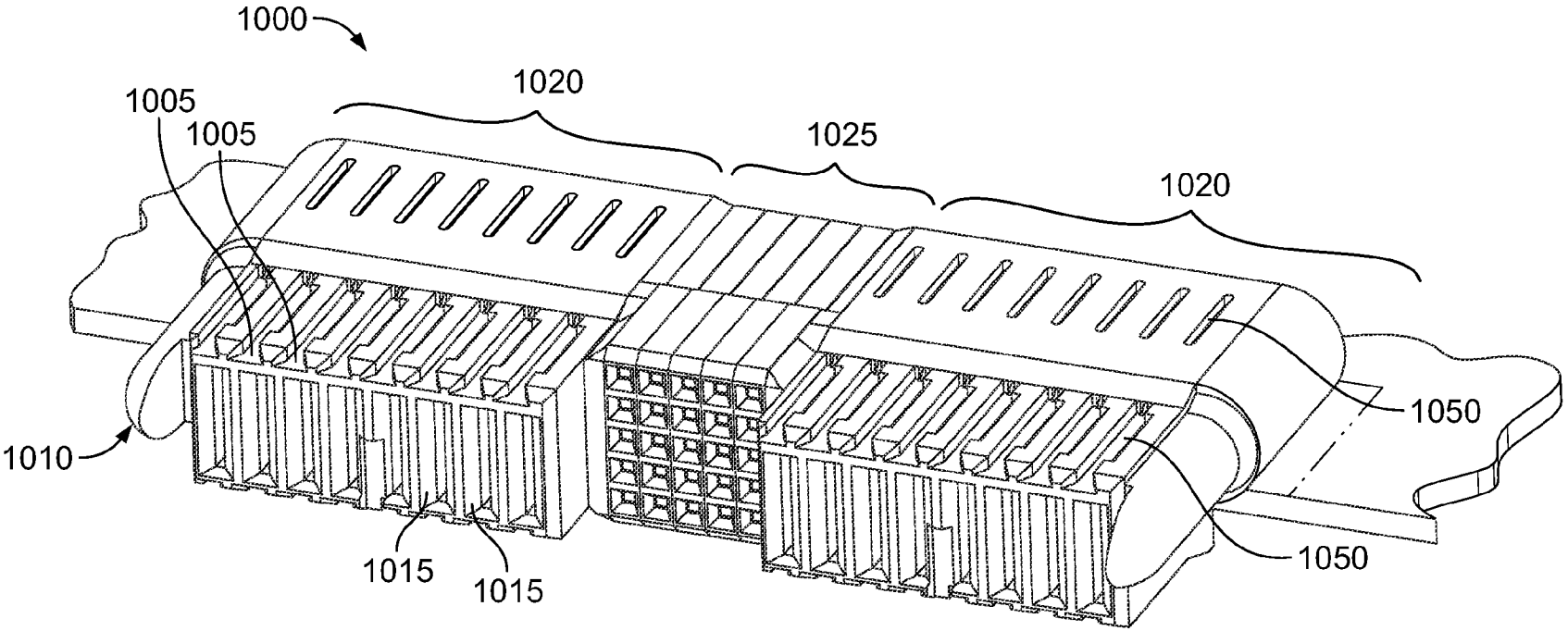
FIG. 10 illustrates an exemplary receptacle power/signal connector.

FIG. 10 illustrates a more detailed view of an exemplary embodiment of a receptacle power/signal connector 1000. As shown in FIG. 10, receptacle connector 1000 is provided with cooling slots 1050 formed in the power connection sections 1020 of the connector 1000. Receptacle connector 1000 also includes a signal connection section 1025 for housing receptacle signal connectors (not shown) within the connector 1000.

Cooling slots 1050 are formed similarly as the cooling slots of the receptacle power connector embodiment previously discussed. Receptacle connector 1000 includes top rib receiving slots 1005 for receiving corresponding ribs from a plug connector. Additional rib receiving slots may be provided on the bottom of the connector 1000 if the corresponding plug connector has bottom ribs. Receptacle connector 1000 is shown with a tab 1010 to be inserted into a corresponding guide opening of a plug connector.

The receptacle connector 1000 has support columns 1015 for guiding corresponding plug power contacts into mating alignment with receptacle contacts (not shown) contained within the connector. Support columns 1015 may be beveled as shown to assist in guiding plug contacts to their corresponding receptacle contacts.

The power/signal connector assembly 800 may be provided with support ribs and corresponding support column recesses as provided for in the power connector assembly to improve the strength of the connector assembly. Support ribs may be used between groupings of four or more adjacent contacts to improve strength of the contact assembly.

Figure 11A:
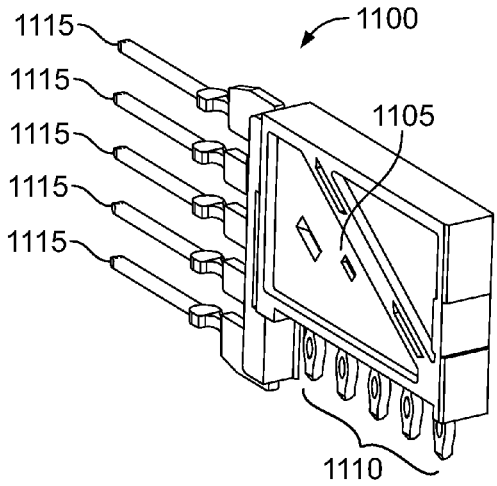
FIGS. 11(*a*) and 11(*b*) illustrate an exemplary plug signal contact array.
Figure 11B:
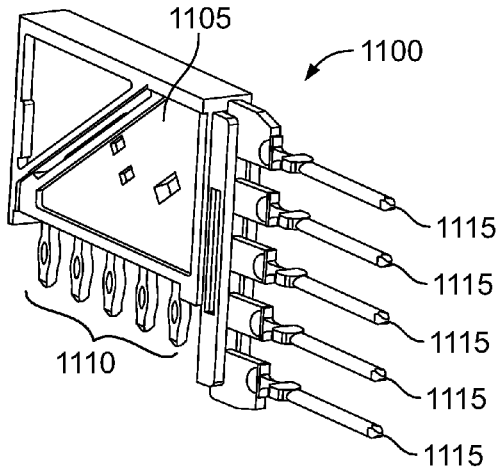

A detailed view of a plug signal contact 1100, as described and shown above with respect to FIG. 9, is shown in FIGS. 11(A) and 11(B). The signal contact 1100 is formed with a body 1105, compliant pins 1110, and a front protrusion 1115 for providing an electrical mating surface to a suitable receptacle signal contact. The compliant pins 1110 are configured to forming an electrical connection with a circuit board by known methods in the art. The plug signal contact 1100 may be formed of a conductive pliant material such as phosphor bronze.

Figure 12A:
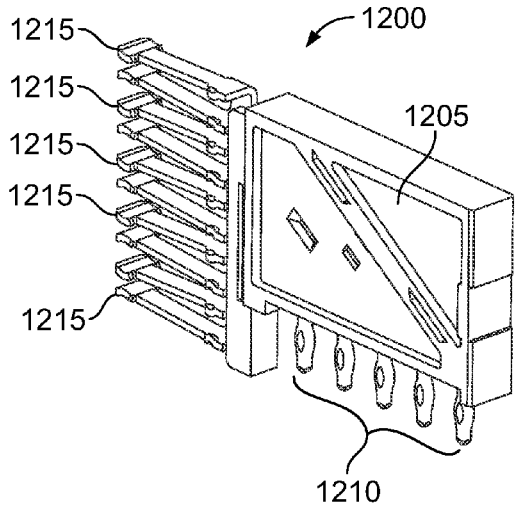
FIGS. 12(*a*) and 12(*b*) illustrate an exemplary receptacle signal contact array.
Figure 12B:
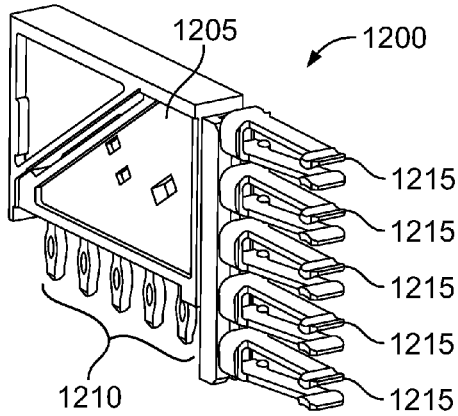

An enlarged detailed view of a receptacle signal contact 1200, as described and shown above with respect to FIG. 10, is shown in FIGS. 12(*a*) and 12(*b*). The receptacle contact 1200 is shown with a body 1205, compliant pins 1210, and a front receiving contact 1215 for providing an electrical mating surface to a suitable corresponding plug protrusion. The receptacle signal contact 1200 may be formed of conductive pliant material such as phosphor bronze.

Figure 13:
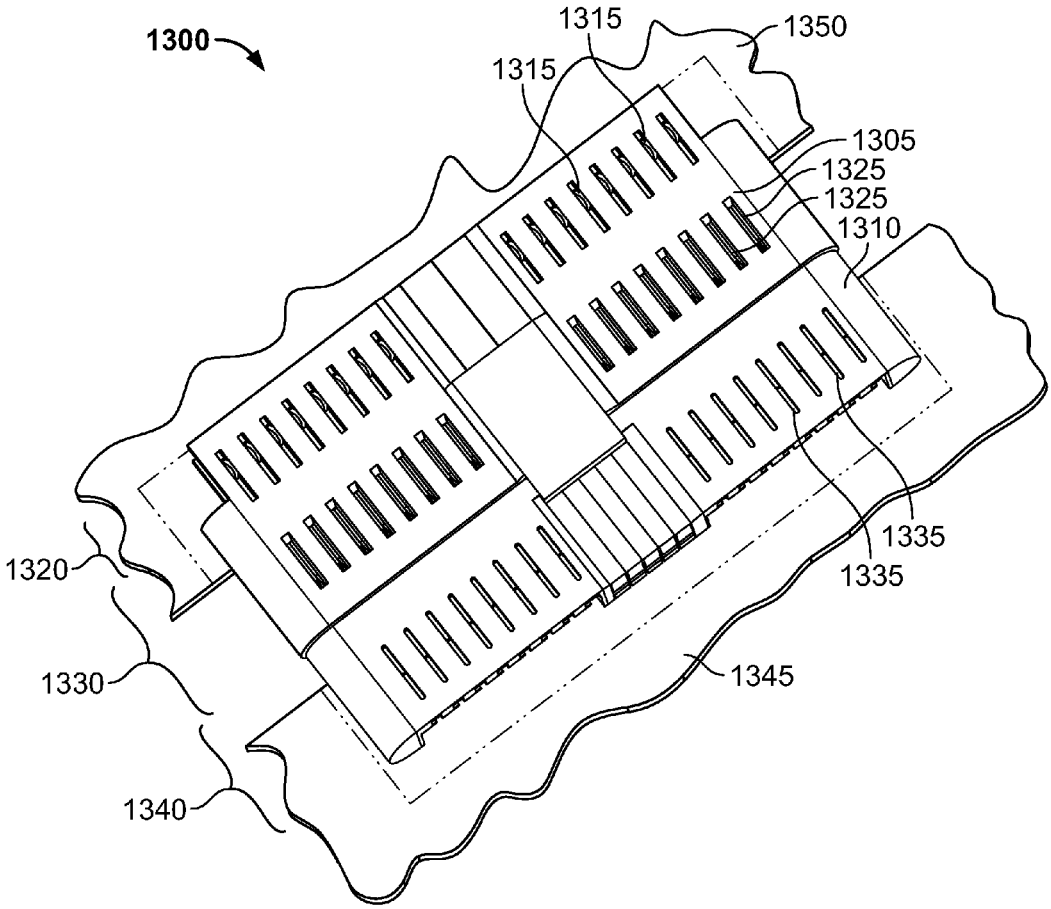
FIG. 13 illustrates an exemplary mated power/signal connector assembly.

FIG. 13 illustrates a mated power/signal connector assembly 1300 formed by a plug power/signal connector 1305 and a receptacle power/signal connector 1310 according to sill another exemplary embodiment of the present invention. The plug connector 1305 is shown with cooling slots 1315 in the plug tail section 1320. FIG. 13 also shows cooling slots 1325 formed into the plug shroud section 1330. Not shown in FIG. 13 are the cooling slots formed into the receptacle shroud section contained within the plug shroud section 1330 and aligned with cooling slots 1325. The receptacle connector 1310 has cooling slots 1335 formed into the receptacle connector tail section 1340. The mated power connector assembly 1300 establishes an electrical power connection between a first circuit board 1345 and a second circuit board 1350.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector assembly, comprising:

a plug connector comprising a plug housing comprising a tail section and a shroud section and at least one plug power contact;

a receptacle connector comprising a receptacle housing comprising a tail section and a shroud section and at least one receptacle power contact;

wherein the plug connector and the receptacle connector are configured to mate with one another and establish an electrical connection between the plug power contact and the receptacle power contact; and wherein the plug housing includes a plug mating face and support ribs along the plug mating face, and the receptacle housing includes a receptacle mating face and recesses along the receptacle mating face for receiving the support ribs of the plug housing when the plug connector and the receptacle connector are mated.

2. The connector assembly of claim 1, wherein the shroud section of the plug connector surrounds the shroud section of the receptacle connector when the plug connector and the receptacle connector are mated.

3. The connector assembly of claim 1, wherein the plug connector comprises at least one plug signal contact and wherein the receptacle connector comprises at least one receptacle signal contact.

4. The connector assembly of claim 1, wherein the plug housing comprises an at least partially open rear face that exposes the plug power contact to cooling air to provide sufficient heat dissipation to permit the flow of high current.

5. The connector assembly of claim 1, wherein the plug housing further comprises a slotted support structure that supports and aligns the at least one plug power contact.

6. The connector assembly of claim 1, wherein the receptacle housing comprises an at least partially open rear face that exposes the plug power contact to cooling air to provide sufficient heat dissipation to permit the flow of high current.

7. The connector assembly of claim 1, wherein the shroud section of the plug connector includes a top wall and a bottom wall, top ribs along an inner surface of the top wall and bottom ribs along an inner surface of the bottom wall, and the shroud section of the receptacle connector has corresponding slots that receive the top ribs and the bottom ribs.

8. The connector assembly of claim 1, wherein the plug housing includes at least one cooling slot in the tail section and at least one cooling slot in the shroud section and the receptacle housing further includes at least one cooling slot in the tail section and at least one cooling slot in the shroud section, the cooling slots arranged and disposed to permit dissipation of heat by aligning the at least one cooling slot in the shroud section of the plug housing with the at least one cooling slot in the shroud section of the receptacle housing when the plug connector and the receptacle connector are mated.

9. An electrical connector assembly, comprising:

a plug connector comprising a plug housing comprising a tail section and a shroud section, the plug housing holding plug power contacts;

a receptacle connector comprising a receptacle housing comprising a tail section and a shroud section, the receptacle housing holding receptacle power contacts;

wherein the plug connector and the receptacle connector are configured to mate with each other and establish, electrical connections between the plug power contacts and the receptacle power contacts;

wherein the tail section of the plug housing comprises a slotted support structure that supports and aligns the plug power contacts;

wherein the shroud section of the plug housing includes a plug mating face and support ribs along the plug mating face; and wherein the receptacle housing includes a receptacle mating face and recesses along the receptacle mating face for receiving the support ribs of the plug housing when the plug connector and the receptacle connector are mated.

10. The connector assembly of claim 9, wherein the receptacle housing includes support columns that guide the plug power contacts into mating engagement with the receptacle power contacts.

11. The connector assembly of claim 10, wherein the recesses are defined in the support columns.

12. The connector assembly of claim 9, wherein the shroud section of the plug connector includes a top wall and a bottom wall, top ribs along an inner surface of the top wall and bottom ribs along an inner surface of the bottom wall, and the shroud section of the receptacle connector has corresponding slots that receive the top ribs and the bottom ribs.

13. The connector assembly of claim 12, wherein the support ribs extend from the bottom wall to the slotted support structure.

14. The connector assembly of claim 9, wherein the plug housing includes at least one cooling slot in the tail section and at least one cooling slot in the shroud section and the receptacle housing further includes at least one cooling slot in the tail section and at least one cooling slot in the shroud section, the cooling slots arranged and disposed to permit dissipation of heat by aligning the at least one cooling slot in the shroud section of the plug housing with the at least one cooling slot in the shroud section of the receptacle housing when the plug connector and the receptacle connector are mated.

15. An electrical connector comprising:

a plug connector comprising a plug housing comprising a tail section and a shroud section, the plug housing holding plug power contacts;

wherein the tail section comprises a slotted support structure that supports and aligns The plug power contacts;

wherein the shroud section includes a top wall and a bottom wall, top ribs along an inner surface of the top wall and bottom ribs along an inner surface of the bottom wall, a plug mating face within the shroud section and support ribs along the plug mating face; and wherein the support ribs extend from the bottom wall to the slotted support structure.

16. The electrical connector of claim 15, wherein the shroud section includes cooling slots arranged and disposed to permit dissipation of heat by aligning with corresponding cooling slots in a mating receptacle connector.

* * * * *